US010752480B2

(12) United States Patent
Kimura

(10) Patent No.: US 10,752,480 B2
(45) Date of Patent: Aug. 25, 2020

(54) FORKLIFT AND FORK CONTROL METHOD

(71) Applicant: Mitsubishi Logisnext Co., Ltd., Kyoto (JP)

(72) Inventor: Harukazu Kimura, Kyoto (JP)

(73) Assignee: MITSUBISHI LOGISNEXT CO., LTD., Kyoto (JP)

( * ) Notice: Subject to any disclaimer, the term of this patent is extended or adjusted under 35 U.S.C. 154(b) by 0 days.

(21) Appl. No.: 16/465,182

(22) PCT Filed: Dec. 19, 2016

(86) PCT No.: PCT/JP2016/087727
§ 371 (c)(1),
(2) Date: May 30, 2019

(87) PCT Pub. No.: WO2018/116336
PCT Pub. Date: Jun. 28, 2018

(65) Prior Publication Data

US 2020/0002144 A1 Jan. 2, 2020

(51) Int. Cl.
*B66F 9/07* (2006.01)
*B66F 9/22* (2006.01)
(Continued)

(52) U.S. Cl.
CPC ..... *B66F 9/22* (2013.01); *B66F 9/07559* (2013.01); *F15B 11/048* (2013.01); *F15B 13/0401* (2013.01); *F15B 2211/205* (2013.01)

(58) Field of Classification Search
CPC .... B66F 9/07559; B66F 9/22; F15B 13/0401; F15B 11/048; F15B 2211/205
See application file for complete search history.

(56) References Cited

U.S. PATENT DOCUMENTS 5,287,699 A * 2/1994 Takamura ..... E02F 9/221 60/327
9,631,613 B2 * 4/2017 Ueda ..... F04B 35/045
(Continued)

FOREIGN PATENT DOCUMENTS

WO 2008006928 1/2008

OTHER PUBLICATIONS

International Search Report in corresponding international application No. PCT/JP2016/087727, dated Mar. 7, 2017.

*Primary Examiner* — Abiy Teka
(74) *Attorney, Agent, or Firm* — Kirschstein, Israel, Schiffmiller & Pieroni, P.C.

(57) ABSTRACT

A forklift includes forks, cylinders for causing the forks to perform an ascending/descending operation in accordance with the flow rate of hydraulic oil, a first valve for controlling the flow rate of the hydraulic oil in accordance with an energizing current, a second valve 6 for regulating the flow rate of the hydraulic oil in accordance with cylinder pressure, and a control portion that calculates the flow rate to be regulated by the second valve, on the basis of cylinder pressure detected by a pressure sensor, calculates a current command value for the energizing current, with the flow rate to be controlled by the first valve being set equal to the regulated flow rate, and changes the energizing current in two stages, with the current command value as the upper limit of the energizing current, thereby decelerating the forks in two stages when stopping the ascending/descending operation.

7 Claims, 9 Drawing Sheets

(51) Int. Cl.

| | |
|---|---|
| ***B66F 9/075*** | (2006.01) |
| ***F15B 11/048*** | (2006.01) |
| ***F15B 13/04*** | (2006.01) |

(56) References Cited

U.S. PATENT DOCUMENTS

| | | | | |
|---|---|---|---|---|
| 2009/0312875 | A1* | 12/2009 | Lehtonen | B66F 9/07559 700/280 |
| 2013/0013159 | A1* | 1/2013 | Moriki | H02P 21/05 701/50 |
| 2015/0233086 | A1* | 8/2015 | Takaura | E02F 9/2285 414/685 |

* cited by examiner (A)

(B)

FORKLIFT AND FORK CONTROL METHOD

TECHNICAL FIELD

The present invention relates to forklifts and fork control methods.

BACKGROUND ART

FIG. 7 illustrates a conventional forklift 1C. The forklift 1C includes forks 3 for holding a load 2, cylinders 4 for causing the forks 3 to ascend or descend at a speed corresponding to the flow rate of hydraulic oil, a first valve (e.g., electromagnetic proportional control valve) 5 for controlling the flow rate of hydraulic oil, a second valve (e.g., flow regulator valve) 6 for regulating the flow rate of hydraulic oil between the cylinders 4 and the first valve 5 in accordance with cylinder pressure (the weight of the load 2), a control portion 27 for controlling the first valve 5, and a lift lever 8 for starting/stopping the ascending/descending operation of the forks 3.

The cylinders 4 are connected to a hydraulic portion 10 of the forklift 1C via the second valve 6 and the first valve 5, as shown in FIG. 8. The hydraulic portion 10 includes a tank 10A containing the hydraulic oil, a pump 10B for supplying the hydraulic oil in the tank 10A to the first valve 5, a motor 10C for driving the pump 10B, a hydraulic oil supply path, and a hydraulic oil discharge path.

The control portion 27 includes a current calculation portion 27A for calculating a current command value on the basis of an angle of the lift lever 8, and a current supply portion 27B for supplying the first valve 5 with an energizing current in accordance with the current command value. The lever angle is zero when the lift lever 8 is in neutral position. For example, the forks 3 descend when the lever angle is positive, ascend when the lever angle is negative, and stop when the lever angle is zero.

Incidentally, the forklift 1C has a problem in that the load 2 is vertically vibrated when the ascending/descending operation of the forks 3 is started or stopped. A known solution to this problem is an approach to changing the ascending/descending speed of the forks 3 in two stages. This approach cancels out a vibration caused by the first speed change with a vibration caused by the second speed change, and therefore, the load 2 is inhibited from vibrating (e.g., see Patent Document 1).

This will be described below taking as an example the case where the descending operation of the forks 3 is stopped. As shown in FIG. 9(A), at time $t_0$, the angle of the lift lever 8 is X (where X>0), and the forks 3 are descending at a speed corresponding to the lever angle X.

Once the angle of the lift lever 8 changes from X to 0 at time $t_1$, the current calculation portion 27A decreases the current command value in two stages. Assuming that the current command value is B3 mA when the lever angle is X, the current calculation portion 27A decreases the current command value by half from B3 mA to B4 mA over a period from time $t_1$ to time $t_{1'}$, and further decreases the current command value from B4 mA to 0 mA over a period from time $t_2$ to time $t_{2'}$ (see FIG. 9(B)).

The current supply portion 27B decreases the energizing current by half from B3 mA to B4 mA over a period from time $t_1$ to time $t_{1'}$ and further decreases the energizing current from B4 mA to 0 mA over a period from time $t_2$ to time $t_{2'}$.

At the center of gravity G of the load 2, a first vibration occurs at time $t_1$ at which the descending speed of the forks 3 is changed for the first time, and a second vibration, which is 180° out of phase from the first vibration and has the same amplitude as the first vibration (strictly, a smaller amplitude due to attenuation), occurs at time $t_2$ at which the descending speed of the forks 3 is changed for the second time (see FIG. 9(C)). Accordingly, the first vibration is cancelled out by the second vibration, with the result that the load 2 is inhibited from vibrating.

PRIOR ART DOCUMENT

Patent Document

Patent Document 1: Japanese National Phase PCT Laid-Open Publication No. 2009-542555

DISCLOSURE OF THE INVENTION

Problems to be Solved by the Invention

As described above, the conventional forklift 1C changes the ascending/descending speed of the forks 3 in two stages regardless of the flow rate of hydraulic oil that is regulated by the second valve 6. Accordingly, when the flow rate of hydraulic oil is regulated by the second valve 6, the first vibration is not sufficiently cancelled out by the second vibration, with the result that the effect of inhibiting the load 2 from vibrating is reduced.

The present invention has been achieved under the above circumstances, with a problem thereof being to provide a forklift and a fork control method, both of which inhibit load vibration even when the flow rate of hydraulic oil is regulated.

Solution to the Problems

To solve the above problem, the present invention provides a forklift including forks for holding a load, cylinders for causing the forks to perform an ascending/descending operation at an ascending/descending speed in accordance with a flow rate of hydraulic oil, a first valve for controlling the flow rate of hydraulic oil in accordance with an energizing current, a second valve for regulating the flow rate of hydraulic oil between the cylinders and the first valve in accordance with cylinder pressure on the cylinders, a control portion for supplying the energizing current to the first valve, an operating portion for stopping the ascending/descending operation, and a pressure sensor for detecting the cylinder pressure, the control portion calculates the flow rate to be regulated by the second valve based on the cylinder pressure, the control portion calculates a current command value for the energizing current, with the flow rate to be controlled by the first valve being set equal to the regulated flow rate, and the control portion changes the energizing current in two stages, with the current command value being set as an upper limit of the energizing current, thereby decelerating the forks in two stages when stopping the ascending/descending operation.

Preferably, in the forklift, the operating portion causes the ascending/descending operation to start, the control portion calculates the regulated flow rate based on the cylinder pressure, the control portion calculates the current command value, with the controlled flow rate being set equal to the regulated flow rate, the control portion changes the energizing current in two stages, with the current command value being set as the upper limit of the energizing current, thereby accelerating the forks in two stages when starting the ascending/descending operation.

Preferably, in the forklift, the control portion calculates a first command value for the energizing current in accordance with an amount of manipulation of the operating portion, when the first command value is greater than a second command value being the current command value, the control portion changes the energizing current in two stages, with the second command value being set as the upper limit of the energizing current, and when the first command value is less than the second command value, the control portion changes the energizing current in two stages, with the first command value being set as the upper limit of the energizing current.

The forklift can be configured such that the forklift includes a memory portion having first data and second data stored therein, the first data indicating the relationship between the cylinder pressure and the regulated flow rate, the second data indicating the relationship between the energizing current and the controlled flow rate, and the control portion includes a first command calculation portion for calculating the first command value in accordance with the amount of manipulation, a second command calculation portion for calculating the regulated flow rate based on the cylinder pressure and the first data and the second command value based on the regulated flow rate and the second data, and a current supply portion for changing the energizing current in two stages, with the second command value being set as the upper limit of the energizing current when the first command value is greater than the second command value and the first command value being set as the upper limit of the energizing current when the first command value is less than the second command value.

The forklift can be configured such that the first command calculation portion includes a speed calculation portion for calculating a speed command value for the ascending/descending speed in accordance with the amount of manipulation, and a current calculation portion for calculating the first command value based on the speed command value.

Furthermore, to solve the above problem, the present invention provides a method for controlling forks of a forklift including forks for holding a load, cylinders for causing the forks to perform an ascending/descending operation at an ascending/descending speed in accordance with a flow rate of hydraulic oil, a first valve for controlling the flow rate of hydraulic oil in accordance with an energizing current, a second valve for regulating the flow rate of hydraulic oil between the cylinders and the first valve in accordance with cylinder pressure on the cylinders, a control portion for supplying the energizing current to the first valve, and an operating portion for starting and stopping the ascending/descending operation, the method including a first step for the control portion to calculate a first command value for the energizing current in accordance with an amount of manipulation of the operating portion, a second step for the control portion to calculate the flow rate to be regulated by the second valve based on the cylinder pressure, calculate a second command value for the energizing current, with the flow rate to be controlled by the first valve being set equal to the regulated flow rate, and compare the first command value and the second command value, and a third step for the control portion to change the energizing current in two stages in accordance with the comparison result, with the second command value being set as an upper limit of the energizing current when the first command value is greater than the second command value and the first command value being set as the upper limit of the energizing current when the first command value is less than the second command value, and the forks are accelerated in two stages when starting the ascending/descending operation and decelerated in two stages when stopping the ascending/descending operation.

In the method, it is preferred that in the second step, the control portion calculate the regulated flow rate based on first data and the second command value based on second data, the first data indicating the relationship between the cylinder pressure and the regulated flow rate, the second data indicating the relationship between the energizing current and the control flow rate.

Effect of the Invention

The present invention renders it possible to provide a forklift and a fork control method, both of which inhibit load vibration even when the flow rate of hydraulic oil is regulated.

MODE FOR CARRYING OUT THE INVENTION

Hereinafter, embodiments of a forklift and a fork control method according to the present invention will be described with reference to the accompanying drawings. Note that as an example of the forklift, a reach forklift will be described. Unless otherwise specified, front/rear, right/left, and up/down directions will be given with respect to a body of the reach forklift.

First Embodiment

Figure 1:
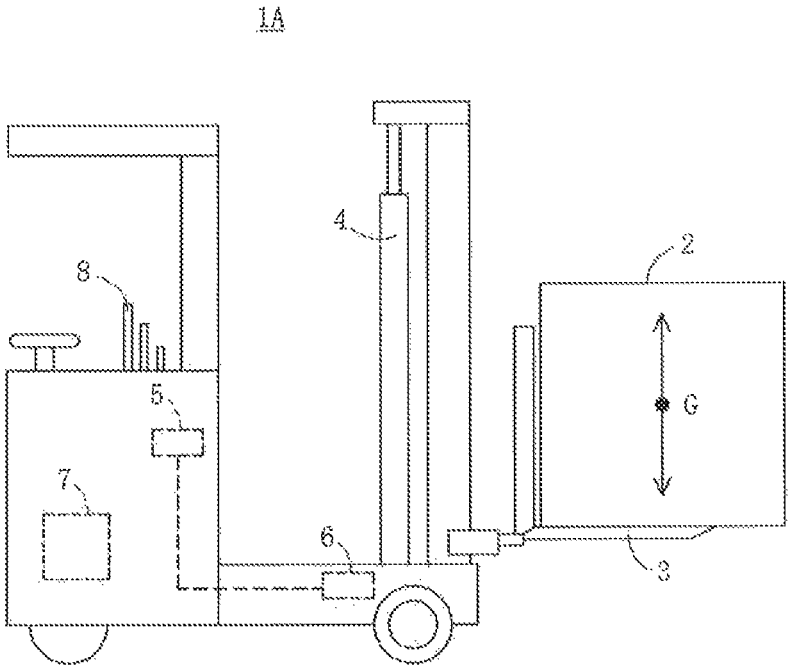
FIG. 1 is a side view of a forklift according to a first embodiment of the present invention.

FIG. 1 illustrates a reach forklift (hereinafter, forklift) 1A according to a first embodiment of the present invention.

The forklift 1A includes forks 3 for holding a load 2, cylinders 4 for causing the forks 3 to ascend or descend at a speed corresponding to the flow rate of hydraulic oil, a first valve 5, a second valve 6, a control portion 7, and a lift lever 8. The lift lever 8 corresponds to the "operating portion" of the present invention.

The operator of the forklift 1A tilts the lift lever 8 from neutral to ascend position (e.g., backward) in order to start the operation of extending the cylinders 4 and thereby start the ascending operation of the forks 3. The operator tilts the lift lever 8 from neutral to descend position (e.g., forward) in order to start the operation of retracting the cylinders 4 and thereby start the descending operation of the forks 3. Moreover, the operator returns the lift lever 8 to the neutral position in order to stop the operation of extending or retracting the cylinders 4 and thereby stop the ascending/descending operation of the forks 3.

The lift lever 8 includes an angle detection means (e.g., a potentiometer). The angle detection means detects the angle (corresponding to the "amount of manipulation" in the present invention) of the lift lever 8 and outputs a signal regarding the lever angle, assuming that the lever angle is 0 when the lift lever 8 is in the neutral position. For example, the lever angle is positive when the forks 3 are descending, negative when the forks 3 are ascending, and 0 when the forks 3 are not moving.

Figure 2:
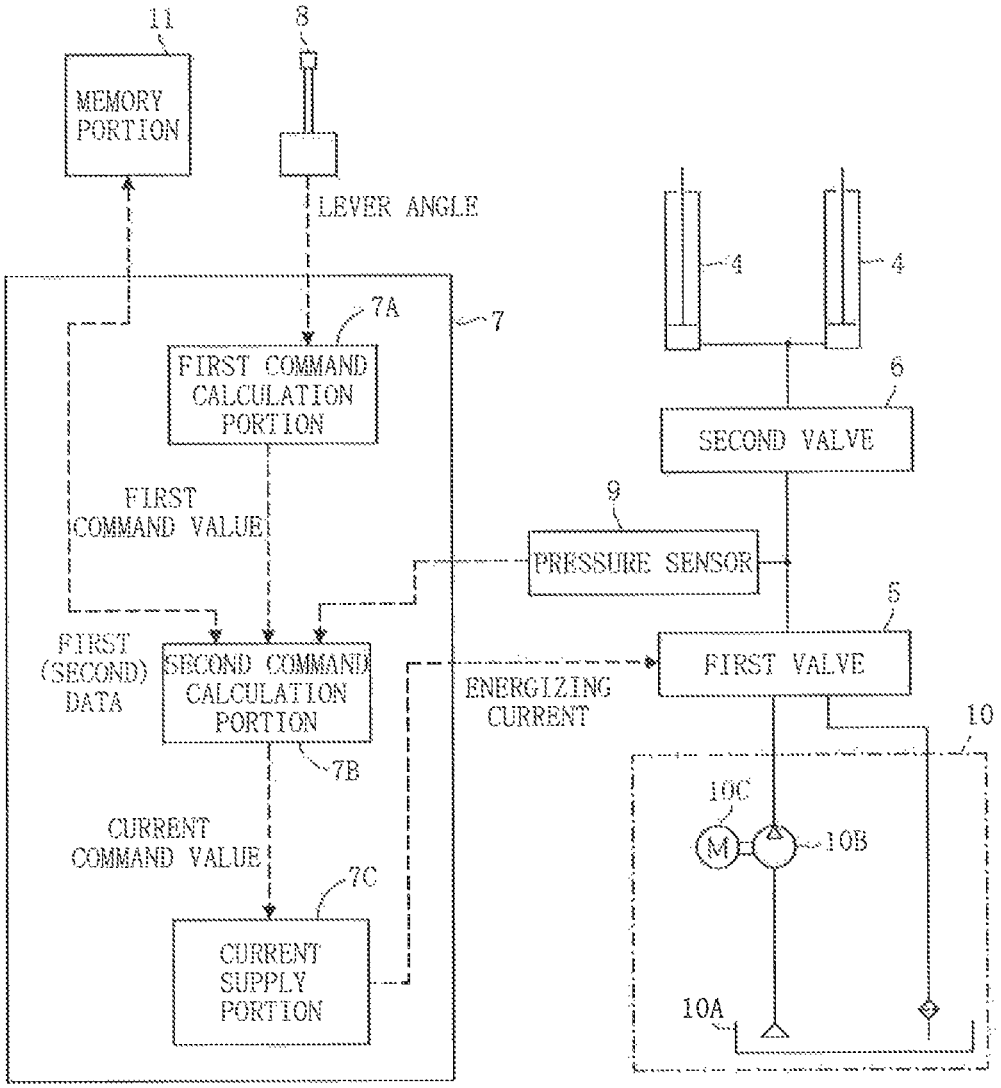
FIG. 2 is a diagram illustrating a control portion and peripheral components in the first embodiment.

The forklift 1A further includes a pressure sensor 9 for detecting pressure (cylinder pressure) on the cylinders 4, a hydraulic portion 10, and a memory portion 11, as shown in FIG. 2. The cylinders 4 are connected to the hydraulic portion 10 via the second valve 6 and the first valve 5.

The first valve 5 is, for example, an electromagnetic proportional control valve and controls the flow rate of hydraulic oil in accordance with an energizing current (e.g., a solenoid current). The flow rate (controlled flow rate) of hydraulic oil passing through the first valve 5 increases as the energizing current increases, and also decreases as the energizing current decreases.

The second valve 6 is, for example, a flow regulator valve and regulates the flow rate of hydraulic oil between the cylinders 4 and the first valve 5 in accordance with cylinder pressure proportional to the weight of the load 2. The flow rate regulated by the second valve 6 is lower on the high-pressure side than on the low-pressure side. For example, when the cylinder pressure (the weight of the load 2) is high, the flow rate regulated by the second valve 6 might become lower than the flow rate controlled by the first valve 5. The present invention aims to inhibit the load 2 from vibrating in such a case.

The pressure sensor 9 is a hydraulic pressure sensor for detecting hydraulic pressure (cylinder pressure) between the cylinders 4 and the first valve 5. The cylinder pressure increases in proportion to the weight of the load 2. The pressure sensor 9 detects cylinder pressure, thereby indirectly detecting the weight of the load 2. The pressure sensor 9 outputs a voltage signal having a linear relationship with the detected cylinder pressure to a second command calculation portion 7B of the control portion 7.

The hydraulic portion 10 includes a tank 10A containing hydraulic oil, a pump 10B for supplying the hydraulic oil in the tank 10A to the first valve 5, a motor 10C for driving the pump 10B, a hydraulic oil supply path, and a hydraulic oil discharge path.

The control portion 7 is, for example, a control 1C (integrated circuit), and includes a first command calculation portion 7A, the second command calculation portion 7B, and a current supply portion 7C. The memory portion 11 is, for example, semiconductor memory. The memory portion 11 has stored therein data (first data) indicating the relationship between the cylinder pressure and the flow rate to be restricted by the second valve 6, and data (second data) indicating the relationship between the energizing current and the flow rate to be controlled by the first valve 5.

The first command calculation portion 7A corresponds to the current calculation portion 27A of the conventional forklift 1C. The first command calculation portion 7A calculates a first command value for the energizing current in accordance with a lever angle inputted by means of the lift lever 8. For example, the first command calculation portion 7A has in advance data indicating the relationship between the lever angle and the first command value, so as to calculate the first command value based on the data upon input of the lever angle. Note that the data may be stored in the memory portion 11.

The second command calculation portion 7B calculates the flow rate to be regulated by the second valve 6 on the basis of the cylinder pressure and the first data, calculates an energizing current (second command value) from the second data, with the flow rate to be controlled by the first valve 5 being set equal to the regulated flow rate, and compares the first and second command values. When the first command value is less than or equal to the second command value, a current command value whose upper limit is the first command value is outputted to the current supply portion 7C, whereas when the first command value is greater than the second command value, a current command value whose upper limit is the second command value is outputted to the current supply portion 7C.

The current supply portion 7C changes the energizing current by equal amounts in two stages, with the current command value received from the second command calculation portion 7B being set as the upper limit of the energizing current. As a result, the ascending/descending speed of the forks 3 is changed by equal amounts in two stages.

In this manner, in the forklift 1A according to the present embodiment, when the flow rate to be regulated by the second valve 6 is lower than the flow rate to be controlled by the first valve 5, the second command calculation portion 7B outputs the second command value calculated from the cylinder pressure, as a current command value, and the current supply portion 7C changes the energizing current by equal amounts in two stages, with the second command value being set as the upper limit of the energizing current. Thus, the forklift 1A according to the present embodiment renders it possible to inhibit the load 2 from vibrating even when the flow rate of hydraulic oil is regulated by the second valve 6.

Described next is a fork control method according to the present embodiment, more specifically, a method for controlling the forks of the forklift 1A.

The fork control method according to the present embodiment includes a first step in which the first command calculation portion 7A calculates a first command value, a second step in which the second command calculation portion 7B outputs a current command value (first or second command value), and a third step in which the current supply portion 7C changes an energizing current in two stages, with the current command value being set as the upper limit of the energizing current.

Figure 3:
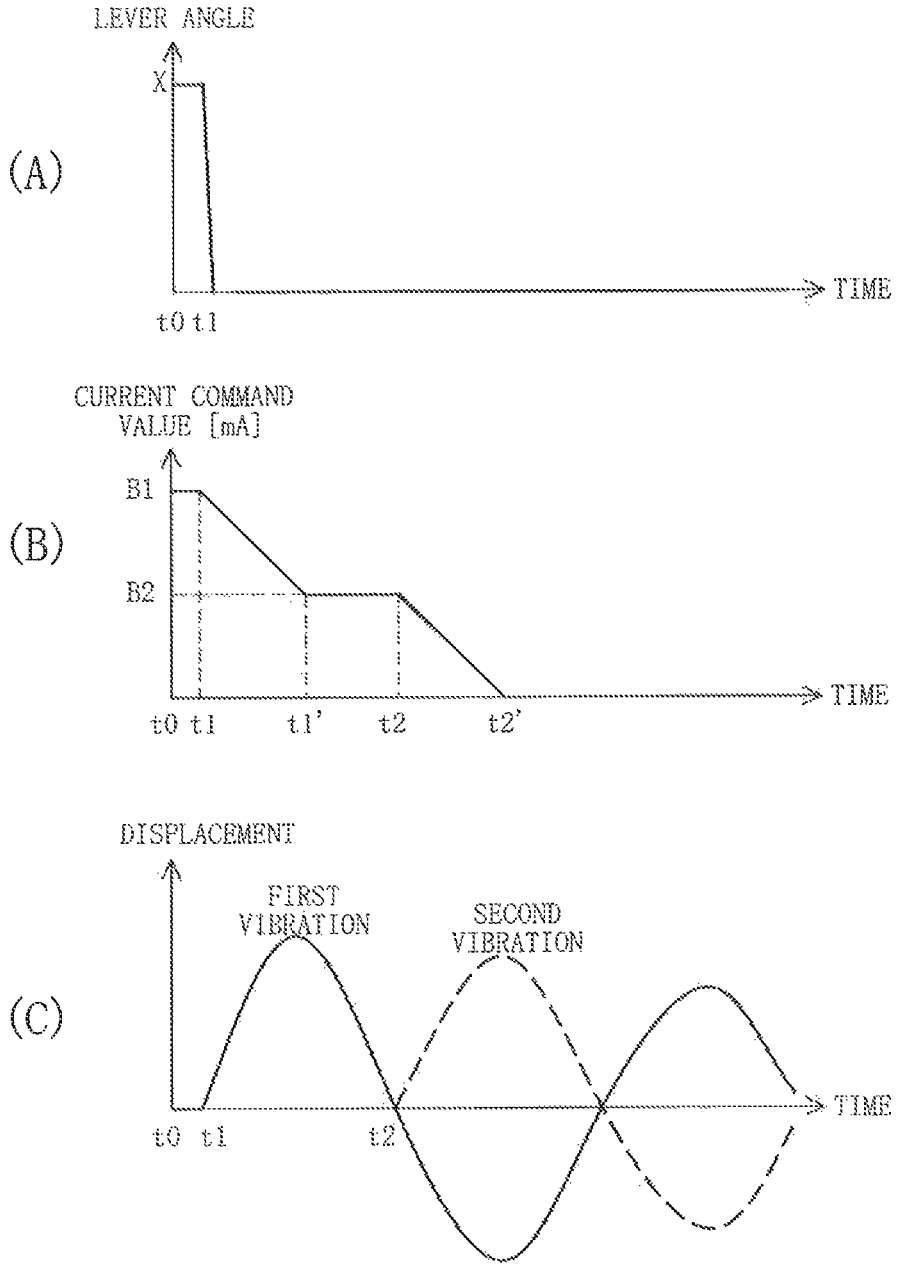
FIG. 3 provides graphs showing (A) lever angle, (B) current command value, and (C) first and second vibrations where a descending operation is stopped in the first embodiment.

The first through third steps will be specifically described below taking as an example the case where the descending operation of the forks 3 is stopped. As shown in FIG. 3(A), at time $t_0$, the angle of the lift lever 8 is X (where X>0), and the forks 3 are descending at a speed in accordance with the lever angle X.

Once the angle of the lift lever 8 changes from X to 0 at time $t_1$, the first command calculation portion 7A calculates a first command value for an energizing current in accordance with the angle of the lift lever 8. Assuming here that the energizing current is B3 mA when the lever angle is X, the first command calculation portion 7A calculates the first command value to be B3 mA. The first command calculation portion 7A outputs the first command value (B3 mA) to the second command calculation portion 7B (the first step ends here).

Figure 4:
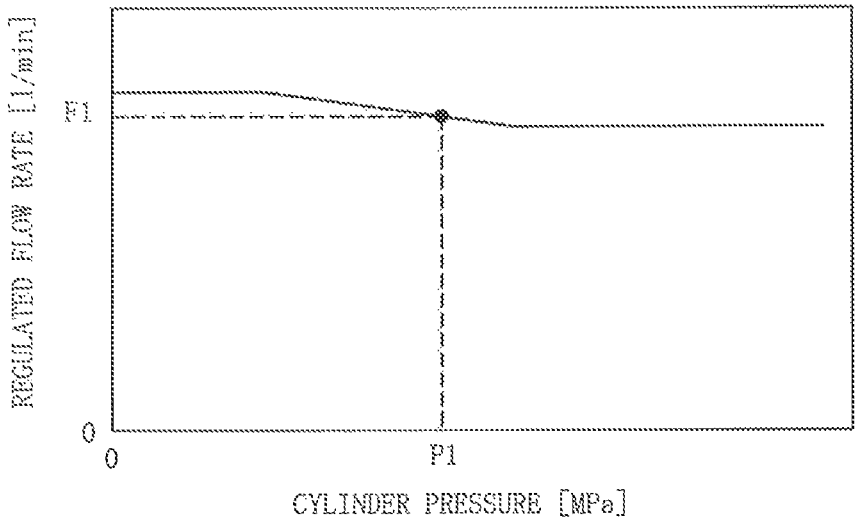
FIG. 4 provides graphs showing (A) first data and (B) second data in the first embodiment.
Figure 4:
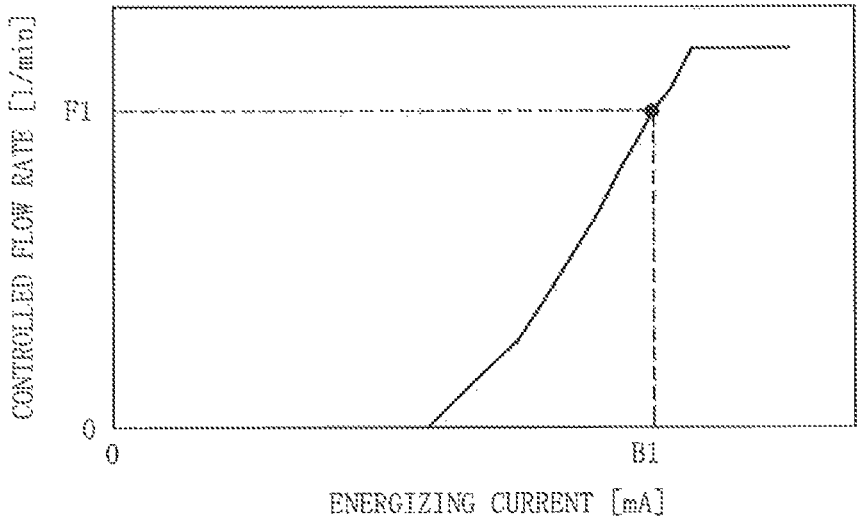

Upon input of the first command value (B3 mA), as well as cylinder pressure from the pressure sensor 9, the second command calculation portion 7B calculates the flow rate to be regulated by the second valve 6, on the basis of the cylinder pressure and the first data stored in the memory portion 11. When the cylinder pressure is P1 MPa, and the first data is data as shown in FIG. 4(A), the second command calculation portion 7B calculates the flow rate to be regulated by the second valve 6 to be F1 l/min.

Next, the second command calculation portion 7B calculates an energizing current (second command value) from the second data stored in the memory portion 11, with the control flow rate for the first valve 5 being set equal to the regulated flow rate (F1 l/min). When the second data is data as shown in FIG. 4(B), the second command calculation portion 7B calculates the second command value to be B1 mA.

Next, the second command calculation portion 7B compares the first command value (B3 mA) with the second command value (B1 mA). When the first command value (B3 mA) is greater than the second command value (B1 mA), the second command calculation portion 7B outputs the second command value (B1 mA) to the current supply portion 7C as a current command value.

It should be noted that in the above comparison, the second command calculation portion 7B performs an operation to subtract the second command value from the first command value, and when the operation result is positive, a value obtained by subtracting the operation result from the first command value, i.e., the second command value, is outputted to the current supply portion 7C as a current command value. On the other hand, when the operation result is less than or equal to 0, the second command calculation portion 7B outputs the first command value to the current supply portion 7C as a current command value (the second step ends here).

Next, the second command calculation portion 7B changes the current command value in two stages, as shown in FIG. 3(B). The second command calculation portion 7B decreases the current command value by half from B1 mA to B2 mA over a period from time $t_1$ to time and further decreases the current command value from B2 mA to 0 mA over a period from time $t_2$ to time $t_{2'}$.

Correspondingly, the current supply portion 7C decreases the energizing current by half from B1 mA to B2 mA over a period from time $t_1$ to time $t_{1'}$ and further decreases the energizing current from B2 mA to 0 mA over a period from time $t_2$ to time $t_{2'}$ (the third step ends here).

Here, time $t_2$ is the time at which the displacement of a first vibration makes the first return to 0, as shown in FIG. 3(C). The first vibration is a vibration caused at the center of gravity G of the load 2 at time $t_1$ at which the descending speed of the forks 3 is changed for the first time. By changing the descending speed of the forks 3 for the second time at time $t_2$, a second vibration is caused at the center of gravity G of the load 2. When the descending speed of the forks 3 is decreased in equal amounts in two stages as described above, the second vibration has approximately the same amplitude as the first vibration and is 180° out of phase from the first vibration. As a result, the first vibration is cancelled out by the second vibration, with the result that the load 2 is inhibited from vibrating.

In the case where the descending speed of the forks 3 is changed for the second time at time $t_2$, it is preferable to store vibration data for the first and second vibrations in the memory portion 11. The vibration data for the first vibration is data regarding, for example, relations of the phase and the amplitude of the first vibration with the cylinder pressure and the energizing current. Similarly, the vibration data for the second vibration is data regarding, for example, relations of the phase and the amplitude of the second vibration with the cylinder pressure and the energizing current. Based on the vibration data, the second command calculation portion 7B decides at time $t_1$ the time (time $t_2$) to change the descending speed of the forks 3 for the second time.

In this manner, in the fork control method according to the present embodiment, when the flow rate to be regulated by the second valve 6 is lower than the flow rate to be controlled by the first valve 5, the second command calculation portion 7B outputs the second command value, which is calculated from the cylinder pressure, as the current command value, and the current supply portion 7C changes the energizing current by equal amounts in two stages, with the second command value being set as the upper limit of the energizing current. Thus, the fork control method according to the present embodiment renders it possible to inhibit the load 2 from vibrating even when the flow rate of hydraulic oil is regulated by the second valve 6.

While the present embodiment has been described taking as an example the case where the descending operation of the forks 3 is stopped, the load 2 can also be inhibited from vibrating in the cases where the descending operation of the forks 3 is started, or the ascending operation of the forks 3 is started or stopped.

Second Embodiment

Figure 5:
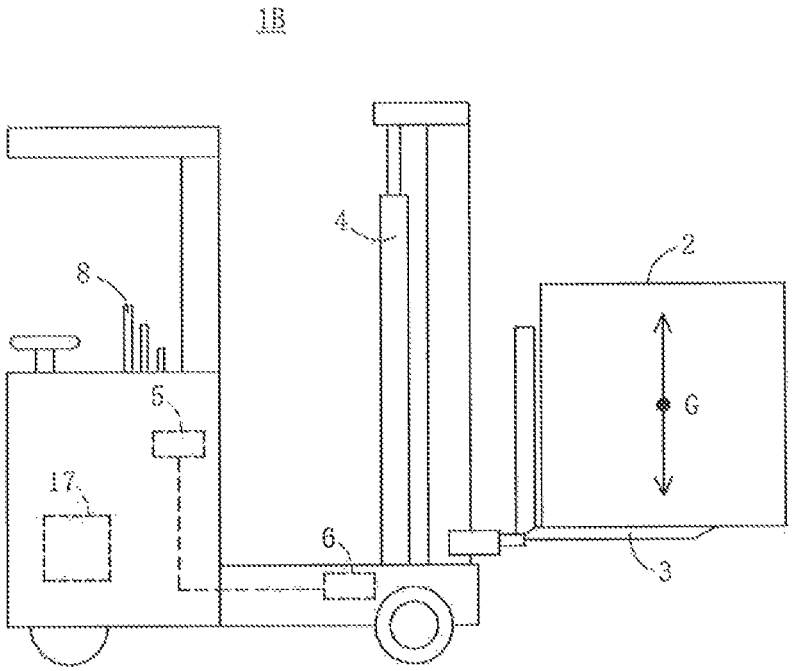
FIG. 5 is a side view of a forklift according to a second embodiment of the present invention.

FIG. 5 illustrates a forklift 1B according to a second embodiment of the present invention.

Figure 6:
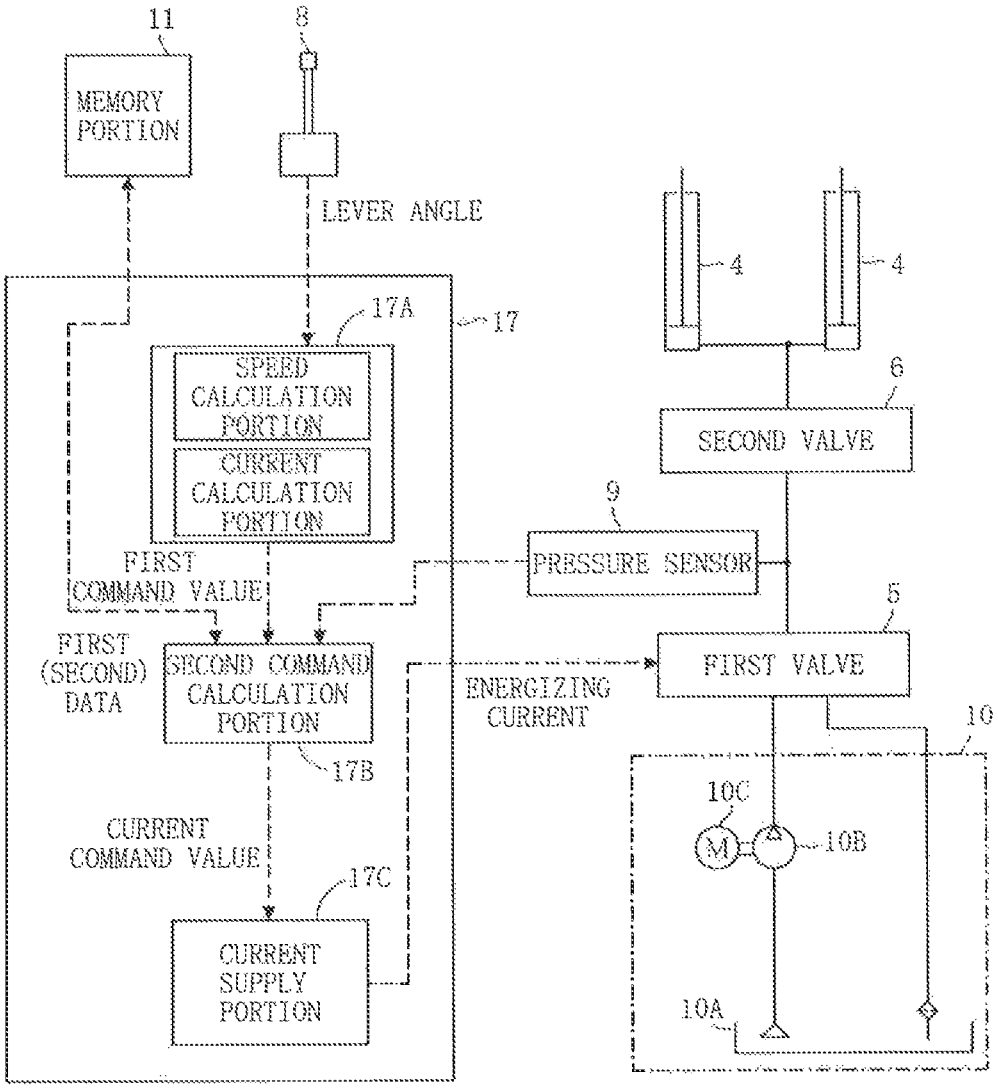
FIG. 6 is a diagram illustrating a control portion and peripheral components in the second embodiment.
Figure 7:
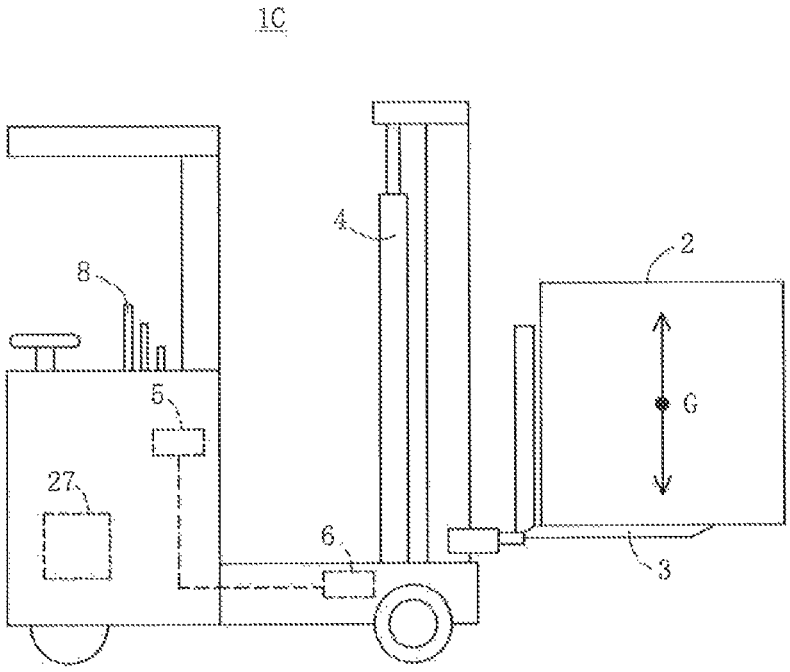
FIG. 7 is a side view of a conventional forklift.
Figure 8:
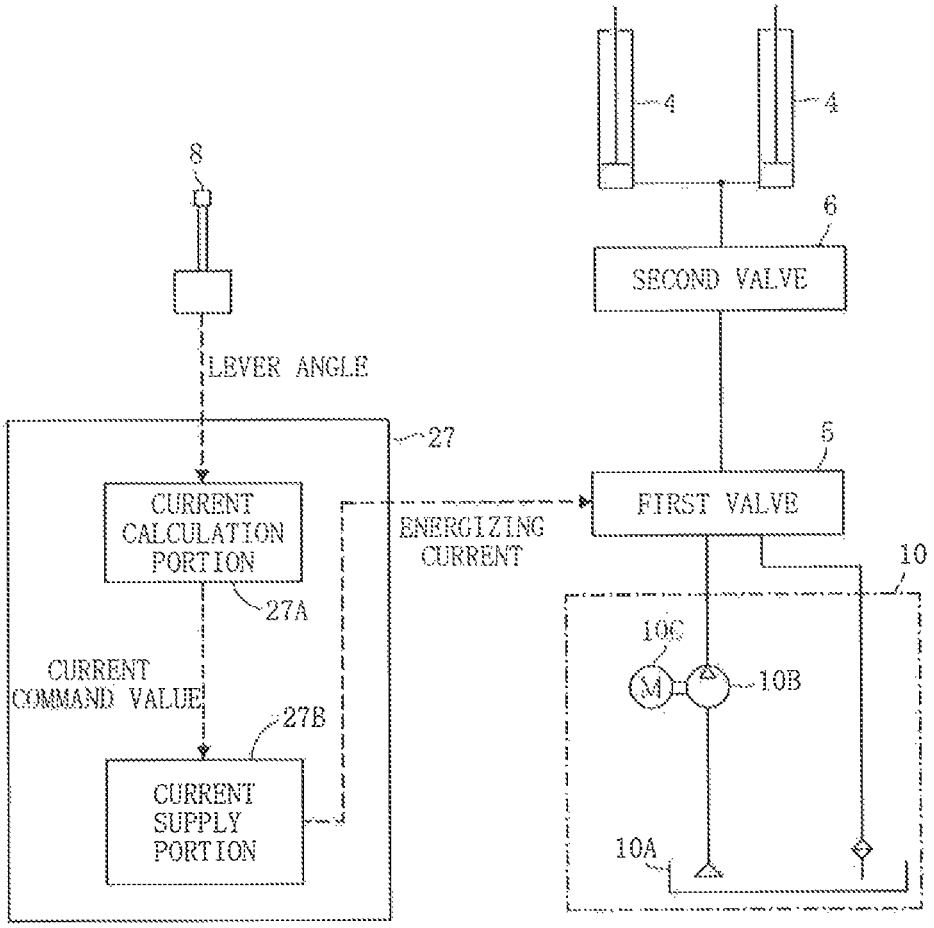
FIG. 8 is a diagram illustrating a control portion and peripheral components of the conventional forklift.
Figure 9:
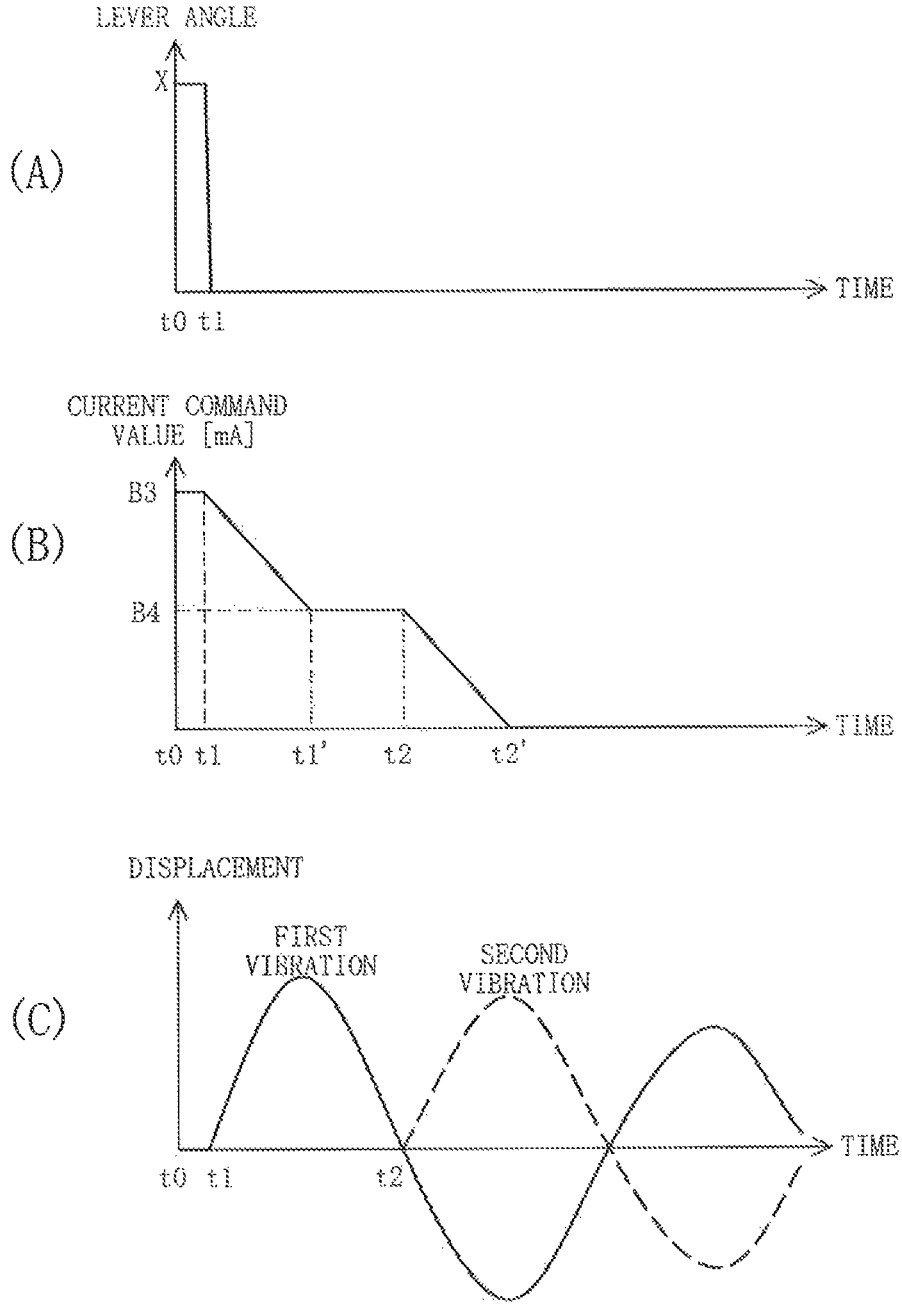
FIG. 9 provides graphs showing (A) lever angle, (B) current command value, and (C) first and second vibrations where the conventional forklift stops a descending operation.

The forklift 1B differs from the first embodiment only in the configuration of the control portion 17. Specifically, the difference from the first embodiment is that the first command calculation portion 17A of the control portion 17 consists of a speed calculation portion and a current calculation portion, as shown in FIG. 6.

The speed calculation portion calculates a speed command value for the forks 3 in accordance with a lever angle inputted by means of the lift lever 8. For example, the speed calculation portion has in advance data indicating the relationship between the lever angle and the speed command value, and once the lever angle is inputted, the speed calculation portion calculates the speed command value on the basis of the data. Note that the data may be stored in the memory portion 11.

Based on the speed command value calculated by the speed calculation portion, the current calculation portion calculates the first command value for the energizing current. For example, the current calculation portion has in advance data indicating the relationship between the speed command value and the first command value, and once the speed command value is inputted, the current calculation portion calculates the first command value on the basis of the data. Note that the data may be stored in the memory portion 11.

Incidentally, the amplitude of the first and second vibrations caused at the center of gravity G of the load 2 has a linear relationship with the speed of the forks 3. In the case where the flow rate of hydraulic oil is not regulated by the second valve 6, the speed of the forks 3 has a linear relationship with the amount of hydraulic oil supplied/discharged by the first valve 5. However, the supplied/ discharged amount has a non-linear relationship with the energizing current, and therefore, even when the energizing current is halved by halving the current command value, the amount supplied/discharged (the descending speed of the forks 3) might not be halved. That is, in some cases, the first and second vibrations cannot be equalized in amplitude, and in such a case, the first vibration cannot be efficiently cancelled out by the second vibration, with the result that the vibration of the load 2 might not be sufficiently reduced.

In this regard, in the forklift 1B according to the present embodiment, the speed calculation portion calculates the speed command value for the forks 3 that has a linear relationship with the vibration amplitude, and therefore, the first and second vibrations can be readily equalized in amplitude. Moreover, the forklift 1B according to the present embodiment renders it possible to inhibit the load 2 from vibrating even when the flow rate of hydraulic oil is regulated by the second valve 6.

Described next is a fork control method according to the present embodiment, i.e., a method for controlling the forks of the forklift 1B.

The fork control method according to the present embodiment shares similarity with the first embodiment in that the method includes a first step in which the first command calculation portion 17A calculates the first command value, a second step in which the second command calculation portion 17B outputs the current command value (first or second command value), and a third step in which the current supply portion 17C changes the energizing current in two stages, with the current command value being set as the upper limit of the energizing current.

On the other hand, the fork control method according to the present embodiment differs from the first embodiment in that, in the first step, the speed calculation portion calculates the speed command value for the forks 3, and the current calculation portion calculates the first command value on the basis of the speed command value.

In this manner, in the fork control method according to the present embodiment, the speed calculation portion calculates the speed command value for the forks 3 that has a linear relationship with the vibration amplitude, and therefore, the first and second vibrations can be readily equalized in amplitude. Moreover, the fork control method according to the present embodiment renders it possible to inhibit the load 2 from vibrating even when the flow rate of hydraulic oil is regulated by the second valve 6.

While the embodiments of the forklift and the fork control method according to the present invention have been described above, the present invention is not limited to the above embodiments.

The forklift and the fork control method according to the present invention are simply required to decelerate the forks 3 in two stages at least when stopping the ascending/descending operation of the forks 3.

The rate of changing the speed at the time of decelerating (or accelerating) the forks 3 in two stages can be suitably changed. For example, when starting the ascending/descending operation, the time during which to change the speed may be shortened as much as possible, so that the forks 3 descend (or ascend) swiftly in two stages. This results in a reduced delay in movement of the forks 3 when starting the ascending/descending operation.

In the first embodiment, the current supply portion 7C changes the energizing current by equal amounts in two stages, with the current command value received from the second command calculation portion 7B being set as the upper limit of the energizing current, but the energizing current does not have to be changed by equal amounts. For example, given the attenuation (e.g., 5 mA) of the first vibration, the current command value may be decreased from B1 mA to B2-5 mA in the first stage (over a period from time $t_1$ to time $t_{1'}$) and further from B2-5 mA to 0 mA in the second stage (over a period from time $t_2$ to time $t_2'$).

The first valve 5 can be suitably changed in configuration so long as the flow rate of hydraulic oil is controlled in accordance with the energizing current. The second valve 6 can be suitably changed in configuration so long as the flow rate of hydraulic oil between the cylinders 4 and the first valve 5 is regulated in accordance with the cylinder pressure.

The control portions 7 and 17 can be suitably changed in configuration so long as the flow rate to be regulated by the second valve 6 is calculated on the basis of the cylinder pressure, the current command value for the energizing current is calculated with the flow rate to be controlled by the first valve 5 being set equal to the regulated flow rate, and the energizing current is changed in two stages, with the current command value being set as the upper limit of the energizing current.

Features other than the lift lever 8 can also be employed as the operating portion of the present invention so long as the ascending/descending operation of the forks 3 can be started/stopped.

The forklift according to the present invention encompasses other forklifts besides the reach forklift.

DESCRIPTION OF THE REFERENCE CHARACTERS

1 forklift
2 load
3 fork
4 cylinder
5 first valve
6 second valve
7, 17 control portion
7A first command calculation portion
7B second command calculation portion
7C current supply portion
8 lift lever
9 pressure sensor
10 hydraulic portion
10A tank
10B pump
10C motor
11 memory portion

The invention claimed is:

1. A forklift comprising:

forks for holding a load;

cylinders for causing the forks to perform an ascending/descending operation at an ascending/descending speed in accordance with a flow rate of hydraulic oil;

a first valve for controlling the flow rate of hydraulic oil in accordance with an energizing current;

a second valve for regulating the flow rate of hydraulic oil between the cylinders and the first valve in accordance with cylinder pressure on the cylinders;

a control portion for supplying the energizing current to the first valve;

an operating portion for stopping the ascending/descending operation; and a pressure sensor for detecting the cylinder pressure, wherein, the control portion calculates a regulated flow rate, being the flow rate to be regulated by the second valve based on the cylinder pressure, the control portion calculates a current command value for the energizing current, with the flowrate to be controlled by the first valve being set equal to the regulated flow rate, and the control portion changes the energizing current in two stages, with the current command value being set as an upper limit of the energizing current, thereby decelerating the forks in two stages when stopping the ascending/descending operation.

2. The forklift according to claim 1, wherein, the operating portion causes the ascending/descending operation to start, the control portion calculates the regulated flow rate based on the cylinder pressure, the control portion calculates the current command value, with the controlled flow rate being set equal to the regulated flow rate, and the control portion changes the energizing current in two stages, with the current command value being set as the upper limit of the energizing current, thereby accelerating the forks in two stages when starting the ascending/descending operation.

3. The forklift according to claim 1 or 2, wherein, the control portion calculates a first command value for the energizing current in accordance with an amount of manipulation of the operating portion, when the first command value is greater than a second command value being the current command value, the control portion changes the energizing current in two stages, with the second command value being set as the upper limit of the energizing current, and when the first command value is less than the second command value, the control portion changes the energizing current in two stages, with the first command value being set as the upper limit of the energizing current.

4. The forklift according to claim 3, comprising:

a memory portion having first data and second data stored therein, the first data indicating the relationship between the cylinder pressure and the regulated flow rate, the second data indicating the relationship between the energizing current and the controlled flow rate, wherein, the control portion includes:

a first command calculation portion for calculating the first command value in accordance with the amount of manipulation;

a second command calculation portion for calculating the regulated flow rate based on the cylinder pressure and the first data and the second command value based on the regulated flow rate and the second data; and a current supply portion for changing the energizing current in two stages, with the second command value being set as the upper limit of the energizing current when the first command value is greater than the second command value and the first command value being set as the upper limit of the energizing current when the first command value is less than the second command value.

5. The forklift according to claim 1 or 2, wherein the first command calculation portion includes;

a speed calculation portion for calculating a speed command value for the ascending/descending speed in accordance with the amount of manipulation; and a current calculation portion for calculating the first command value based on the speed command value.

6. A method for controlling forks of a forklift including forks for holding a load, cylinders for causing the forks to perform an ascending/descending operation at an ascending/descending speed in accordance with a flow rate of hydraulic oil, a first valve for controlling the flow rate of hydraulic oil in accordance with an energizing current, a second valve for regulating the flow rate of hydraulic oil between the cylinders and the first valve in accordance with cylinder pressure on the cylinders, a control portion for supplying the energizing current to the first valve, and an operating portion for starting and stopping the ascending/descending operation, the method comprising:

a first step for the control portion to calculate a first command value for the energizing current in accordance with an amount of manipulation of the operating portion;

a second step for the control portion to calculate a regulated flow rate, being the flow rate to be regulated by the second valve based on the cylinder pressure, calculate a second command value for the energizing current, with the flow rate to be controlled by the first valve being set equal to the regulated flow rate, and compare the first command value and the second command value; and a third step for the control portion to change the energizing current in two stages, with the second command value being set as an upper limit of the energizing current when the first command value is greater than the second command value and the first command value being set as the upper limit of the energizing current when the first command value is less than the second command value, wherein, the forks are accelerated in two stages when starting the ascending/descending operation and decelerated in two stages when stopping the ascending/descending operation.

7. The method according to claim 6, wherein in the second step, the control portion calculates the regulated flow rate based on first data and the second command value based on second data, the first data indicating the relationship between the cylinder pressure and the regulated flow rate, the second data indicating the relationship between the energizing current and the control flow rate.

* * * * *